US007501774B2

(12) United States Patent
Hick et al.

(10) Patent No.: US 7,501,774 B2
(45) Date of Patent: Mar. 10, 2009

(54) MULTI-BUTTON LOW VOLTAGE SWITCH ADAPTABLE FOR THREE STATES

(75) Inventors: Robert L. Hick, Newberg, OR (US); Richard A. Leinen, Wilsonville, OR (US)

(73) Assignee: Leviton Manufacturing Company, Inc., Little Neck, NY (US)

( * ) Notice: Subject to any disclaimer, the term of this patent is extended or adjusted under 35 U.S.C. 154(b) by 266 days.

(21) Appl. No.: 11/381,986

(22) Filed: May 5, 2006

(65) Prior Publication Data

US 2006/0279226 A1 Dec. 14, 2006

Related U.S. Application Data

(60) Provisional application No. 60/677,956, filed on May 5, 2005.

(51) Int. Cl.
*H05B 37/00* (2006.01)
*H05B 37/02* (2006.01)

(52) U.S. Cl. ..... 315/312; 315/291; 315/209 R

(58) Field of Classification Search ..... 315/156–159, 315/154, 149, 105–107, 119, 120, 129, 131, 315/134, 209 R, 246, 291
See application file for complete search history.

(56) References Cited

U.S. PATENT DOCUMENTS 6,388,399 B1 * 5/2002 Eckel et al. ..... 315/158
2002/0033680 A1 * 3/2002 Fehd et al. ..... 315/312

* cited by examiner

*Primary Examiner*—Douglas W Owens
*Assistant Examiner*—Jianzi Chen
(74) *Attorney, Agent, or Firm*—Marger, Johnson & McCollom, PC

(57) ABSTRACT

A light control system having a multi-button low voltage adaptable switch compatible with a two input switch control system where each input can have any one of three values yielding a number of states thus mimicking the functionality of a two button light control switch system. Features such as dimming and daylight harvesting are also disclosed herein. For implementation of a daylight harvesting feature, an ambient light sensor is connected to a detection circuit for sensing and detection of the ambient light level. A number of user-controlled actuators are connected to a decoder that translates a command into a command compatible with the two-input switch.

19 Claims, 3 Drawing Sheets

| ON | OFF |
|---|---|
| 0v | 0v |
| 0v | +12v |
| 0v | +24v |
| +12v | 0v |
| +12v | +12v |
| +12v | +24v |
| +24v | 0v |
| +24v | +12v |
| +24v | +24v |

| ON | OFF | FUNCTION |
|---|---|---|
| 0v | 0v | NO ACTION |
| 0v | +12v | NO ACTION |
| 0v | +24v | OFF |
| +12v | 0v | NO ACTION |
| +12v | +12v | DIM |
| +12v | +24v | BRIGHT |
| +24v | 0v | ON |
| +24v | +12v | NO ACTION |
| +24v | +24v | MAX |

MULTI-BUTTON LOW VOLTAGE SWITCH ADAPTABLE FOR THREE STATES

This application claims the benefit of the filing date of a provisional application having Ser. No. 60/677,956 which was filed on May 5, 2005.

FIELD OF THE INVENTION

The present invention relates to light control switch systems.

BACKGROUND OF THE INVENTION

Daylight harvesting is an available lighting strategy designed to reduce excessive internal light levels during peak consumption hours, wherein external light sources such as daylight substitute for interior electrical lighting. For example, in an office setting, each work area must at all times be provided with a minimum level of light which is determined based upon the tasks performed in the area or zone. Lighting, however, is generally installed by size and number sufficient to provide the minimum light level under the assumption that no other light sources are available in the interior space. Yet, during varying times of the day, other light sources may illuminate the interior space such that the resulting level of light present is excessive. Therefore, the use of interior lighting at the same level of intensity without any regard for the additional sources of lighting becomes a waste of energy.

Specifically, during the day, sunlight may enter through windows and other openings such as skylights. When these external light sources are present, the preset brightness of the interior lighting may not be necessary since the external light sources provide some or all of the minimum light level required. Daylight harvesting eliminates the excessive level of intensity of interior lighting, conserving as much as 84% of the energy required to light a facility at the minimum light level. Relatively bright sunlight, however, can provide at times up to 100% of the required illumination—especially during midday, when energy costs are highest.

Daylight harvesting also enables a constant level of light on work surfaces to avoid moments when the additional sources of light i.e., external light sources, provide an excessive amount of light, resulting in periods of glare. In the alternative, when light levels are low (i.e. when clouds roll in or nighttime falls), daylight harvesting maintains this constant level of light by continuously increasing and/or decreasing (i.e., adjusting) the power applied to the internal lighting. This practice enables a worker in the lighted environment to resolve images with ease. As a result, eyestrain is avoided; and health and productivity are promoted.

Conventional technology for implementing daylight harvesting techniques incorporates the use of digital photo-sensors to detect light levels, wherein the digital photo-sensor is connected to a dimmer control circuit to automatically adjust the output level of electric lighting for promotion of a lighting balance. Dimmer control circuits, as implemented with respect to daylight harvesting, gradually adjust (i.e., increase or decrease) interior lighting in response to photocell measurement of ambient light levels.

In general, dimmer control systems are widely used in indoor lighting to provide a softer feel and more controllable illumination experience as compared to on/off lighting. It is desirable to provide dimmer control systems for fluorescent as well as for incandescent lighting. Conventional dimmer control circuits include on/off switching and up/down power controls. Further, a microprocessor may be incorporated within a dimmer control circuit to provide control for various power-up, power-down and fade in/out functions. Rather than use a variable resistor type rheostat which wastes power and generates heat at low illumination levels, modern dimming control circuits employ phase regulation, in which the power circuit is switched on at a time delay following a zero-crossing of the AC sine wave input until the end of each half cycle, in an effort to supply a variable level of power to the lighting load. For dimming control in fluorescent lamps. a ballast with a controlled low voltage (0-10 V) input is desired.

In conventional low voltage switch systems that do not incorporate features, such as dimming and daylight harvesting, two states exist for each input: ground or 0 volt and a non-zero voltage which is typically +24 volts. Two button switches are known in the industry and are standard. They provide ON and OFF inputs. Many light switch manufacturers in the industry develop most of their products to include an ON and OFF input for each switch control input. One approach for increasing the functionality of a low voltage switch uses three states, wherein each input, ON and OFF, are configured to receive 0 volts or a low voltage, a mid-voltage, and a high voltage. Therefore, given a conventional +24 volt system, the voltage states applied to each input include voltage levels of 0 volt, 12 volts and 24 volts.

In accordance with provisions for light control systems having daylight harvesting and dimming features, Leviton Manufacturing Co. manufactures a multi-button switch, product model CN200, having five buttons (ON, MAX, BRIGHT, DIM and OFF) for switching one or more electrical loads. The ON button turns the lights fully on and activates a daylight harvesting scheme. The OFF button turns the lights off. The MAX button turns the lights on at full brightness and disables the daylight harvesting feature. Finally, the BRIGHT and DIM buttons raise and lower the lighting levels while disabling the daylight harvesting feature. Under typical low voltage switch technology, however, separate inputs and circuitry are necessary to implement such features in a light switch control device similar to that described above. Thereby, the associated cost of components and wiring are increased with each feature.

Thus, there exists a need for a simple, yet, effective design of a multi-button low voltage adaptable switch that may be implemented using the two input switch control system having three input states that mimics the functionality of a light control switch system including features such as dimming and daylight harvesting.

The present invention is directed to overcoming, or at least reducing the effects of one or more of the problems set forth above.

SUMMARY OF THE INVENTION

To address the above-discussed deficiencies of light control switch device, the present invention teaches a light control system having a multi-button low voltage adaptable switch compatible with a two input switch control system where each input is capable of having three different values and each input mimics the functionality of a light control switch system including features such as dimming and daylight harvesting. This novel light control switch device includes a number of user-controlled actuators connected to a decoder that translates a command into a command compatible with the two-input switch system where each switch can have three states. The three states can be represented with three voltages (low, middle and high) of a power supply. A voltage divider network connects to the decoder to generate a high voltage, a mid-voltage and a low voltage signal in accordance with the three possible input values of each of the two input switches.

Specifically, the light control system in accordance with the present invention includes an ambient light sensor connected to a detection circuit for sensing and detection of the ambient light level. A microprocessor connects between the voltage divider network, the detection circuit and a dimming circuitry unit for adjusting the amount of power provided to at least one electrical load in response to a user-actuator command and the ambient light level.

Advantages of this design include but are not limited to a light control switch system that is compatible with the conventional two input low voltage switch and which possesses upgraded features of dimming and daylight harvesting at minimal cost.

In general the present invention is a control device having at least one actuator coupled to circuitry whereby an m signal command is generated when the at least one actuator is engaged. Each of the signals of the generated m signal command can assume any one of N values (e.g., voltage values) to yield a possible $N^m$ states where m is an integer equal to 2 or greater and N is an integer equal to 1 or greater. In one embodiment one specific state can be assigned to a particular actuator so that when such an actuator is engaged the assigned state is caused to occur.

These and other features and advantages of the present invention will be understood upon consideration of the following detailed description of the invention and the accompanying drawings.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein.

DETAILED DESCRIPTION OF PREFERRED EMBODIMENTS

The present invention will now be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Figures 1, 3A, 3B:
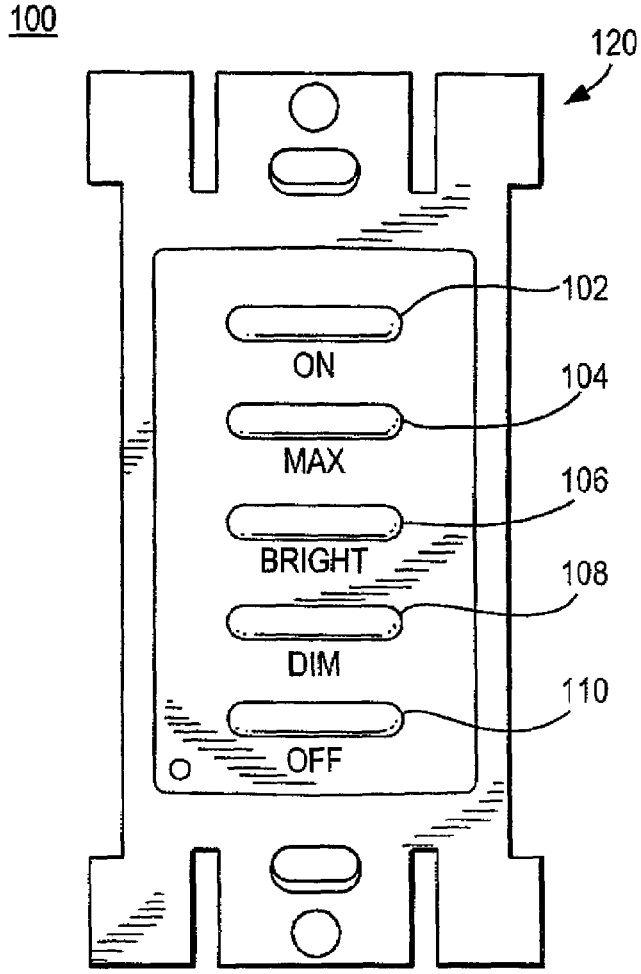
FIG. 1 shows the faceplate of an embodiment of a wall mountable master control of the system in accordance with the present invention.
FIGS. 3A and 3B show permutations of the low voltage, mid-voltage and high voltage inputs from the master control of FIG. 1 for implementation to be compatible with a two input switch unit.

FIG. 1 shows a master control 100 in accordance with the present invention having a faceplate 120. The master control 100 has an "ON" actuator 102, a "MAX" actuator 104, a "BRIGHT" actuator 106, a "DIM" actuator 108 and an "OFF" actuator 110 that actuate switches 202, 204, 206, 208, and 210 respectively (shown in FIG. 2).

Figure 2:
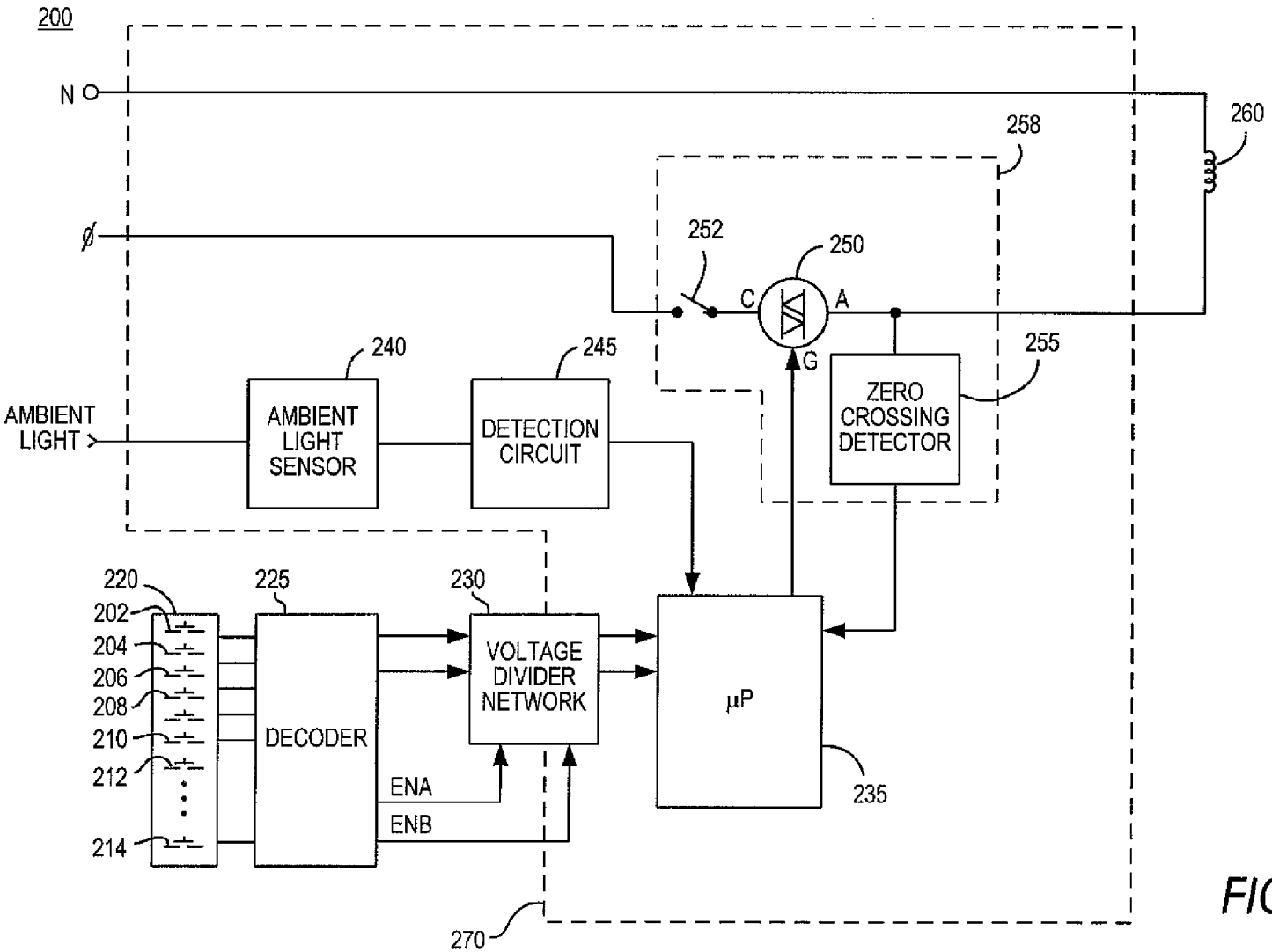
FIG. 2 shows the block diagram of the light switch control system in accordance with the present invention.
Figure 4:
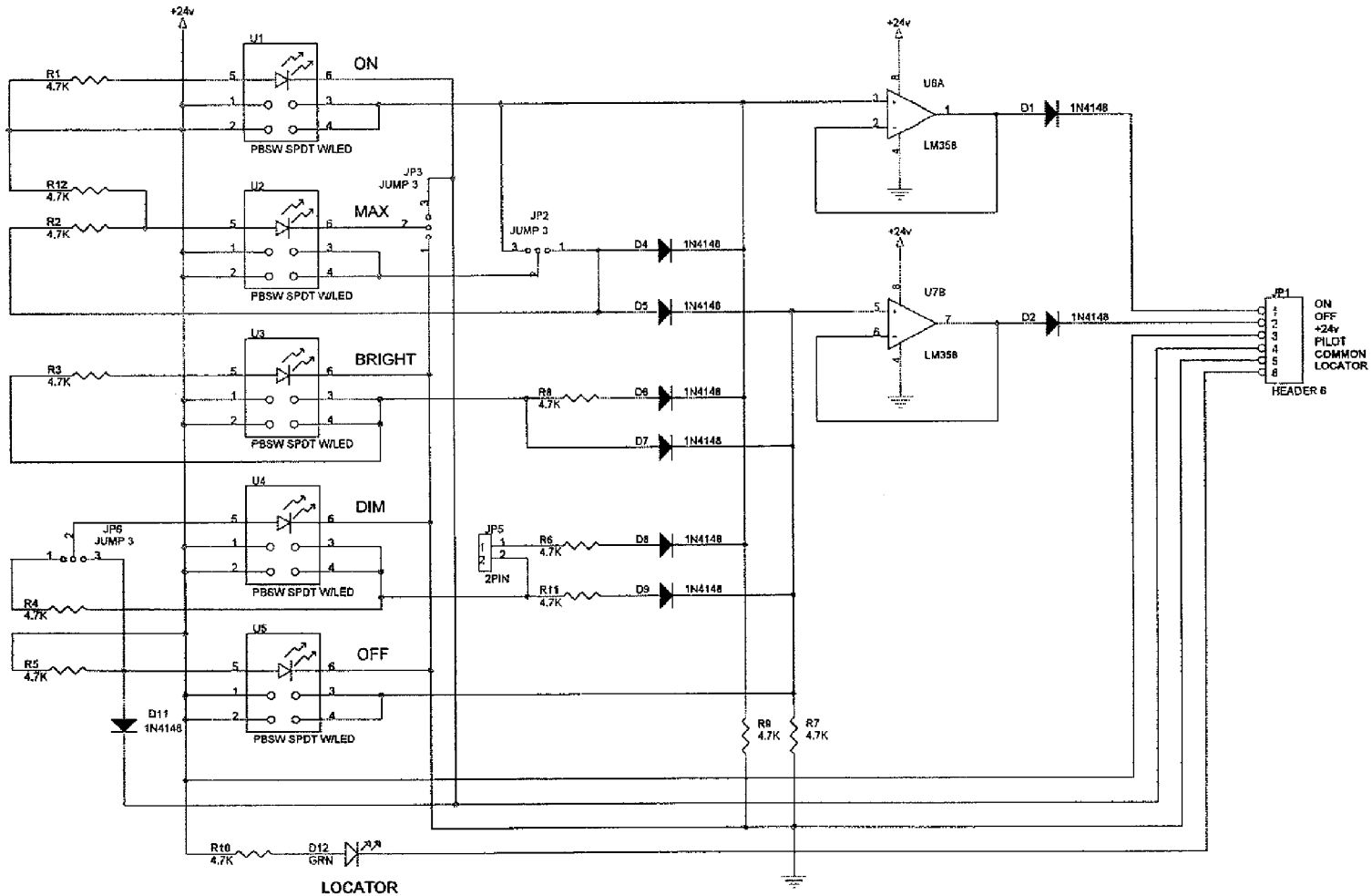
FIG. 4 schematically illustrates an actuator assembly, voltage divider and decoder in accordance with an embodiment of the invention.

FIG. 2 represents the block diagram of the circuitry for the master control switch 200 in accordance with the present invention. The master control light switch 200 may include user accessible actuator assembly 220 comprising one or more actuators (e.g., one or more switches), a decoder 225, a voltage divider network 230 (which may include an A/D converter), and a control device 270 comprising a microprocessor 235, a detection circuit 245, an ambient light sensor 240, and a dimming circuit 258. The dimming circuit comprises a bidirectional controllable switch 250 (e.g., a triac), zero crossing detector circuit 255 and mechanical switch 252. A user of the master control switch 200 is able to engage one of the switches of actuator 220 resulting in a command which decoder 225 translates into a two input signal for microprocessor 235 which interprets these signals as a command (or a set of commands) to perform one or more actions for controlling at least the electrical load 260; more than one load can be controlled by this arrangement. In particular, when one of the switches is engaged decoder 235 transmits the proper signal to voltage divider network 230 causing said divider to generate one set of two voltages thus simulating the two input system. The two voltages can then be converted to digital signals (with the use of an Analog to Digital Converter (A/D), not shown) which are transferred to microprocessor 235. Microprocessor 235 is programmed to perform the particular task associated with the generated two voltage signal. Decoder 225 can be implemented as any well known digital and/or analog electronic circuitry that outputs a two component signal (each signal component can be represented by either a low, middle or high voltage value) based on the particular input of the decoder and the specific mapping of the decoder inputs to its outputs. Thus, when actuator 102 of FIG. 1 is engaged, switch 202 is activated which serves as an input to decoder 225 and the corresponding two component input signal is generated by decoder 225. The two input signal generated by decoder 225 is based on the particular mapping between the particular input of the decoder that was activated and the two component signal generated by the decoder. The voltage divider network 230 generates the proper voltages for the two component input signal generated by the decoder 225.

For example, when the "ON" actuator 102 of FIG. 1 is caused to close switch 202 (of FIG. 2) it causes the decoder 225 to generate a two input signal which has been designated for the "ON" task. Thus, decoder 225 can cause voltage divider network 230 to generate two voltages which are then interpreted by microprocessor 235. Each of the two inputs can take on any one of three voltage values which are generated by voltage divider network 225 and such values are convened to a digital information (via an A/D converter, not shown) which is transferred to the microprocessor 235 (shown in FIG. 2). In the example shown in FIG. 2, the high voltage is 24 volts, the middle voltage is 12 volts and the low voltage is 0 volt. As per FIG. 3B, when one voltage value of one of the input signals to the microprocessor is 24 volts and the other voltage value is 0 volts, the microprocessor will interpret those signals as a command to turn ON the load fully. Accordingly, microprocessor 235 then generates a master-ON signal that causes dimmer circuitry 258 (shown in FIG. 2) to turn the electrical load 260 fully ON. Electrical load 260 is depicted as an incandescent light bulb; it is clear that other types of electrical loads can be attached to the control system of the present invention. For example, the electrical load 260 may be a fluorescent lamp with a ballast, with the dimming circuit configured to provide a low voltage (0-10 V) output to the ballast. Daylight harvesting is also performed by enabling the microprocessor 235 to receive the signal sensed by the ambient light sensor 240 which is detected and converted from an analog signal to a digital one by detection circuit 245.

Daylight harvesting is available using the master control 100 of the present invention to reduce excessive internal light levels during peak consumption hours, wherein external light sources, such as daylight, substitute for interior electrical lighting. The master control system can be operated as follows: actuation of the "MAX" actuator 104 closes switch 204 and causes a corresponding two input signal to be transferred to the microprocessor 235 which outputs a master-MAX signal to enable the dimmer circuitry 258 to turn the electrical load fully ON and disable the daylight harvesting feature. Actuation of the "BRIGHT" actuator 106 closes switch 206 and causes the microprocessor 235 to output a master-RAISE signal to signal the dimmer circuitry 258 to raise the light level and disable the daylight harvesting feature. Actuation of the "DIM" actuator 108 closes switch 208 and causes the microprocessor 235 to output a master-LOWER signal to the dimmer circuitry 258 to dim the light level and disable the daylight harvesting feature. Finally, actuation of the "OFF" actuator 110 closes switch 210 and causes the microprocessor 235 to output a master-OFF signal to the dimmer circuitry 258 to turn the electric load 260 fully off.

Referring back to FIG. 2, the master control switch 200 further includes a detection circuit 245 coupled between an ambient light sensor 240 and microprocessor 235. When light sensor 240 is exposed to light, it produces a small current or signal. The strength of the signal produced is proportional to the amount of light or illumination level sensed. Detection circuit 245 is coupled to sensor 240 to receive the signal generated by light sensor 240, detect the associated light level, and convert the light energy into a digital signal for processing by the microprocessor 235. Consequently, microprocessor 235 signals dimming circuit 258 to adjust the power supplied to the electrical load 260.

Dimmer circuitry 258 can control, for example, the amount of current flowing through electrical load 260 by proper activation of a triac 250. Triac 250 is a bi-directional three terminal semiconductor device that allows bi-directional current flow when an electrical signal of proper amplitude is applied to its gate terminal G. Triac 250 also has a cathode terminal C and an anode terminal A. When an electrical signal is applied to the gate G, triac 250 is said to be gated. When properly gated, current (or other electrical signal) can flow from terminal C to the terminal A or from the terminal A to the terminal C. When triac 250 is not gated or is not properly gated, relatively very little or substantially no current (or no signal) can flow between the terminals, A and C. In sum, triac 250 acts as an electrically controlled switch which can allow some or no current flow based on the amplitude of the electrical signal being applied to its terminal G from microprocessor 235.

Connected in series to triac 250 is mechanical switch 252 which can be implemented using an "air gap switch." This air gap switch may be activated to stop current that flows from the phase terminal (Ø), through switch 252, triac 250 to load 260. Electrical energy from a source (not shown) may provide current that flows into the phase terminal (Ø) to mechanical switch 252, triac 250, load 260, and back to the electrical energy source through neutral terminal N. Accordingly, the amount of current flowing through the phase and neutral terminals, Ø and N, determines the intensity of the illumination of electrical light 260. Note that electrical load 260 can be any other type of electrical load other than a light bulb. In summary, triac 250 can be gated to provide current amounts related to intensities of light 260 or can be gated to provide substantially no current thus essentially switching off light 260 as is required when the "OFF" actuator 110 (shown in FIG. 1) is actuated.

FIGS. 3A and 3B each displays a table for the variations of inputs to be applied and converted into a two input user command for microprocessor 235 to interpret as a user command (or set of user commands). Specifically, FIG. 3A shows the set of all available states when each switch of a two input switch can have any one of three different voltage values (e.g., 0, 12 and 24 volts). In particular, these values may include a low voltage signal, a mid-range voltage signal, and a high voltage signal, wherein the high voltage signal equals the power supply voltage and the mid-range voltage signal equals half of the power supply voltage. As shown there are nine states in total. Eight of the nine states are used to control the load 260. The ninth state exists as essentially an idle state wherein both inputs are at 0 volts. The meaning of this state is that no button is pressed and no action is taken. In general the control switch device of the present invention has at least one actuator coupled to the circuitry described above whereby an m signal command is generated when the at least one actuator is engaged. Each of the signals of the generated m signal command can assume any one of N values (e.g., voltage values) to yield a possible $N^m$ states. In the embodiment described above, each of the actuators of actuator assembly 220 generates 2 input signal (i.e., m=2) where each signal can have three values (i.e., N=3) yielding $N^m$ ($3^2$) or 9 states as shown in FIGS. 3A and 3B. In certain embodiments one specific state can be assigned to a particular actuator so that when such an actuator is engaged the assigned state is caused to occur. In other embodiments, each state of the $N^m$ states is assigned to a different actuator resulting in the control device having $N^m$ actuators.

FIG. 3B represents the state table for the master control switch 100 of FIG. 100. The first state provides that when the first input labeled "On" and the second input labeled "Off" are both at 0 volt, no action is taken. Similarly when the following combinations exist, no action is taken: the first input labeled "On" is at 0 volt and the second input labeled "Off" is at 12 volts; the first input labeled "On" is at 12 volts and the second input labeled "Off" is at 0 volt; and the first input labeled "On" is at 24 volts and the second input labeled "Off" is at 12 volts. When, however, the first input labeled "On" is at 0 volt and the second input labeled "Off" is at 24 volts, the "OFF" state is enabled. The "DIM" state is enabled when the first input labeled "On" and the second input labeled "Off" are both at 12 volts. When the first input labeled "On" is at 12 volts and the second input labeled "Off" is at 24 volts, the "BRIGHT" state is enabled. The "ON" state is enabled when the first input labeled "On" is at 24 volts and the second input labeled "Off" is at 0 volts. Finally, when the first input labeled "On" is at 24 volts and the second input labeled "Off" is at 24 volts, the "MAX" state is enabled.

It should be noted that the control switch system of the present invention is completely compatible with a standard two button switch since ON is mapped with the ON input at 24 volts when the OFF input at 0 volts. Likewise, OFF is mapped such that ON is 0 volts when OFF is 24 volts.

Those of skill in the art will recognize that the physical location of the elements illustrated in FIGS. 1 and 2 can be moved or relocated while retaining the function described above. For example, the actuator buttons may be positioned in a different order.

Advantages of this design include but are not limited to a light switch control system having a high performance, simple, and cost effective design.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

We claim:

1. A light control system for controlling the brightness of at least one electrical load, comprising:

an ambient light sensor that outputs a first signal in response to being exposed to radiation for sensing the ambient light level;

a detection circuit coupled to receive the first signal to detect the light level sensed and convert the signal into a digital signal;

a plurality of user-controlled actuators;

a decoder coupled to receive at least one control signal from the plurality of user-controlled actuators;

a voltage divider network coupled to the decoder to generate a voltage level corresponding to the decoded control signal;

a microprocessor coupled between the voltage divider network and the detection circuit; and a dimming circuitry unit coupled between the microprocessor and the plurality of electrical loads for increasing and decreasing the illumination of the at least one electrical load responsive to the digital signal and the at least one control signal.

2. A light control system for controlling the brightness of at least one electrical load as recited in claim 1, wherein the dimming circuitry comprises:

an air-gap switch coupled to an input phase node for receiving an AC line voltage source;

a triac having a cathode terminal, an anode terminal, and a gate terminal, the cathode terminal coupled to the air-gap switch, the gate terminal coupled to the microprocessor, the anode terminal coupled to the at least one electrical load; and a zero crossing detector circuit coupled between the anode terminal and the microprocessor to detect the zero crossings of the AC line voltage source at predetermined intervals.

3. A light control system according to claim 1, wherein the electrical load further comprises a ballast.

4. A light control system for controlling the brightness of at least one electrical load according to claim 3, wherein the electrical load comprises a fluorescent lamp.

5. A light control system according to claim 3, wherein the dimming circuitry unit is configured to provide an output in the range 0-10 V for controlling the ballast.

6. A control system for controlling a load, the system comprising:

an actuator assembly having at least one actuator;

a decoder, which upon activation of the at least one actuator, generates m input signals wherein each of said m input signals is capable of having any one of N values thus resulting in said decoder having $N^m$ states, wherein m has a value of at least 2 and N has a value of at least 3; and a processor coupled to the decoder, wherein the processor is configured to control the load based on the state of the decoder.

7. A control system according to claim 6, wherein the load comprises a fluorescent lamp.

8. A control system according to claim 7, wherein the load further comprises a ballast.

9. A control system according to claim 8, further comprising a circuit coupled to the processor, said circuit configured to provide an output in the range 0-10 V for controlling the ballast.

10. A method of controlling an electrical load, comprising:

receiving one of a plurality of control signals from at least one of a plurality of user-controlled actuators;

decoding the received one of the plurality of control signals;

generating one of N voltage levels on at least one of m input signals in response to the decoded one of the plurality of control signals, wherein m has a value of at least 2 and N has a value of at least 3; and responsive to the plurality of voltage levels, controlling the electrical load.

11. The method of claim 10, wherein generating the light level signal comprises generating an analog light level signal and converting the analog signal into a digital light level signal.

12. The method of claim 10, wherein the electrical load comprises a ballast.

13. The method of claim 12, wherein the electrical load further comprises a fluorescent lamp.

14. The method of claim 13, wherein controlling the electrical load comprises increasing an illumination level of the fluorescent lamp.

15. The method of claim 13, wherein controlling the electrical load comprises decreasing an illumination level of the fluorescent lamp.

16. The method of claim 10, wherein generating the one of N of voltage levels comprises using a voltage divider network.

17. The method of claim 16, further comprising converting the one of N voltage levels into a plurality of digital signals.

18. The method of claim 10, wherein controlling the electrical load comprises controlling an amount of current flowing through the electrical load.

19. A control system operable to perform the method of claim 10.

* * * * *